US007306488B2

(12) United States Patent
Krijne et al.

(10) Patent No.: US 7,306,488 B2
(45) Date of Patent: Dec. 11, 2007

(54) LUMINOUS UNIT FOR THE AUTOMOTIVE FIELD

(75) Inventors: Johannes Krijne, Geldrop (NL); Jeroen Emmanuel Peter Maria Alting Von Geusau, Champhol (NL); Thomas Mathias Nadenau, Aachen (DE); Karl-Heinz Widmer, Ulm (DE); Marko Areh, Radlje ob Dravi (SI)

(73) Assignee: SVS Spare Parts GmbH (DE)

( * ) Notice: Subject to any disclaimer, the term of this patent is extended or adjusted under 35 U.S.C. 154(b) by 147 days.

(21) Appl. No.: 11/247,082

(22) Filed: Oct. 11, 2005

(65) Prior Publication Data

US 2006/0087855 A1 Apr. 27, 2006

(30) Foreign Application Priority Data

Oct. 11, 2004 (EP) ..... 04292409

(51) Int. Cl.
*H01J 5/54* (2006.01)

(52) U.S. Cl. ..... 439/617; 439/918; 439/699.2

(58) Field of Classification Search ..... 439/617, 439/918, 699.2, 276, 936
See application file for complete search history.

(56) References Cited

U.S. PATENT DOCUMENTS 484,207 A * 10/1892 Klein ..... 439/276
4,427,255 A * 1/1984 Cox ..... 439/548
4,812,703 A * 3/1989 Kanematsu et al. ... 313/318.07
4,879,491 A * 11/1989 Hirozumi et al. ..... 313/318.1
5,711,596 A * 1/1998 Hoover et al. ..... 362/548
5,747,920 A * 5/1998 Devir et al. ..... 313/318.09
6,080,019 A * 6/2000 Coushaine ..... 439/611
6,254,252 B1 * 7/2001 Coushaine et al. ..... 362/549
6,328,455 B1 * 12/2001 Helbig ..... 362/657
6,887,107 B2 * 5/2005 Ohsumi ..... 439/617

* cited by examiner

*Primary Examiner*—Tho D. Ta

(57) ABSTRACT

Luminous units of this kind have light members in the form of incandescent lamps, whose contacts are connected electrically conductive with an electrical connector via an intermediate or contact plate. The contact plate must be fastened separately, owing to which manufacture and assembly are complicated and costly. In order to avoid this, the luminous unit has a light member holder, which is connected with the light member and has a coupling piece for the electrical connector. The coupling connection permits a simple and reliable electrical connection between the light member and the electrical connector. The contacts of the light member have contact pins, which are lengthened by lengthening pins. These allow the contact pins to be directly connected with the electrical connector.

18 Claims, 2 Drawing Sheets

LUMINOUS UNIT FOR THE AUTOMOTIVE FIELD

CROSS-REFERENCE TO RELATED APPLICATIONS

This application claims priority to European Patent Application No. 04292409.2 filed Oct. 11, 2004.

TECHNICAL FIELD

The invention relates to a luminous unit for the automotive field.

BACKGROUND OF THE INVENTION

Luminous units in the automotive field, in which the lighting means, or member such as an incandescent lamp, is connected electrically conductive with the electrical connector via an intermediate plate or contact plate, are well known. This contact plate must be fastened separately in the base of the lighting means. This is complicated and costly.

The object of the invention is to design the luminous unit in such a way that electrical connection between the lighting means and the electrical connector is possible in simple and inexpensive fashion.

According to the invention, this object is accomplished in the luminous unit of the present invention.

SUMMARY OF THE INVENTION

In the luminous unit according to the invention, the coupling piece with which the lighting means is capable of being coupled with the electrical connector, is provided for the lighting means. The coupling connection ensures simple and reliable electrical connection between the lighting means and the electrical connector.

In the accomplishment according to Claim 12, the contact pins of the lighting means are lengthened by lengthening pins. This permits the contact pins to be directly connected with the electrical connector via the lengthening pins. The lengthening pins can be fastened to the contact pins without any problem, so that inexpensive manufacture and assembly is ensured.

Additional features of the invention appear in the additional claims, the description and the drawing.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention is explained in detail by an exemplary embodiment represented in the drawing, wherein

FIGS. 1 to 5 show, on a scale of approximately 1:1, an incandescent lamp 1, which is accommodated in a lamp holder 2.

DETAILED DESCRIPTION OF THE PREFERRED EMBODIMENTS

Figure 1:
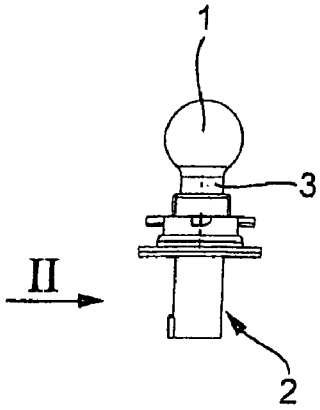
FIG. 1 shows, in side view, an incandescent lamp and lamp holder of the luminous unit according to the invention, FIG. 2, the incandescent lamp and lamp holder of FIG. 1 in a view in the direction of the arrow II in FIG. 1, FIG. 3, a top view of the incandescent lamp and the lamp holder of FIG. 1, FIG. 4, a section along line A-A in FIG. 3, FIG. 5, a section along line B-B in FIG. 3, FIG. 6, the detail C in FIG. 4 in enlarged representation, FIG. 7, the detail D in FIG. 5 in enlarged representation, FIG. 8, the incandescent lamp and lamp holder before assembly, FIG. 9, the incandescent lamp and lamp holder in the assembled state.
Figure 2:
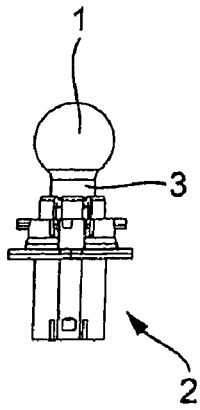
Figure 3:
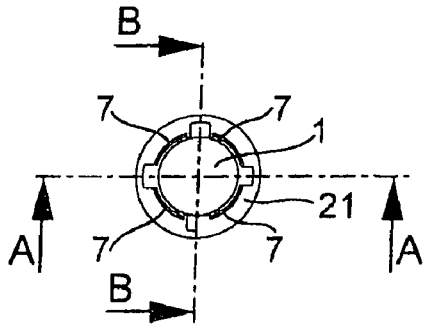
Figure 4:
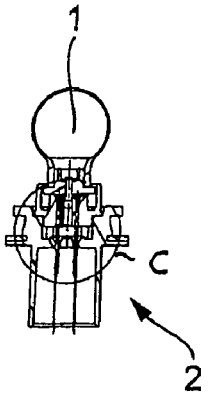
Figure 5:
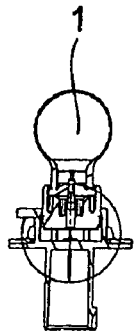
Figure 6:
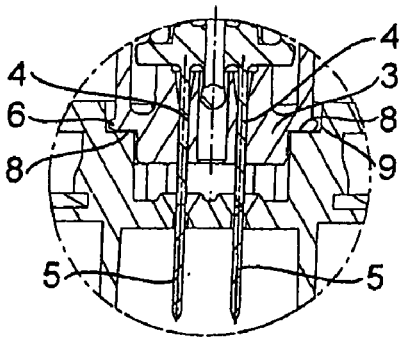
Figure 7:
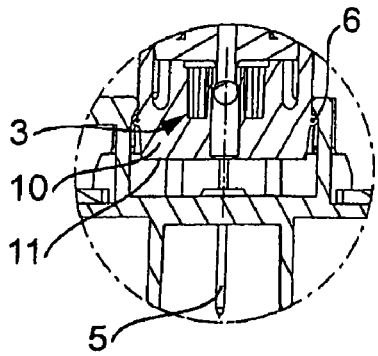
Figure 8:
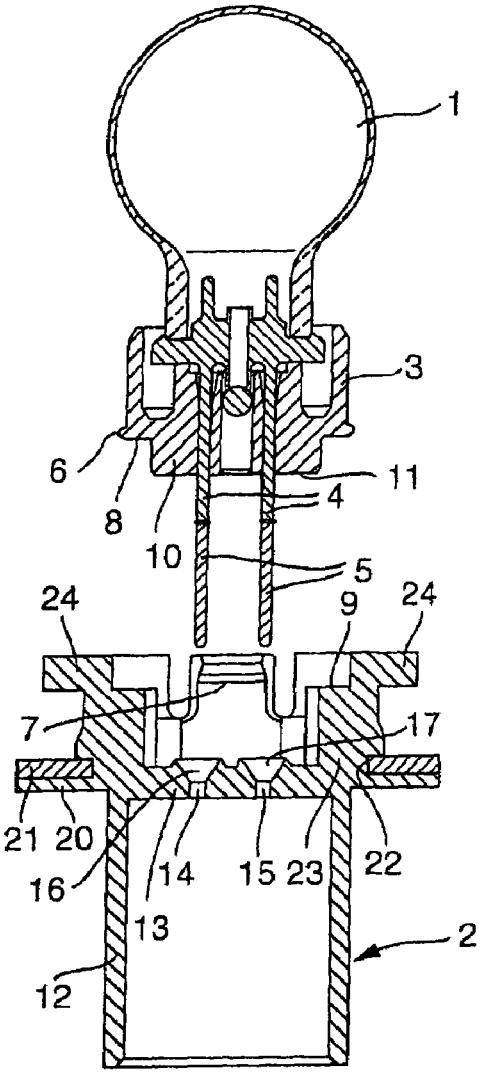

The lamp 1 advantageously is a HiPer incandescent lamp (High Performance incandescent lamp), which is well known and therefore will not be described in detail and is characterized by a long service life. This lamp 1 has a base 3, with which the lamp 1 is inserted into the lamp holder 2 in a manner to be described below. Two contact pins 4, by which the current is supplied, project beyond the base 3. To these contact pins 4 are attached lengthening pins 5, which advantageously are welded to the pins 4 by laser welding. The contact pins 4 and the lengthening pins 5 advantageously have like diameters (FIGS. 6 to 8). The lengthening pins 5 advantageously are so-called MQS pins, which have a quadrangular cross section.

Figure 9:
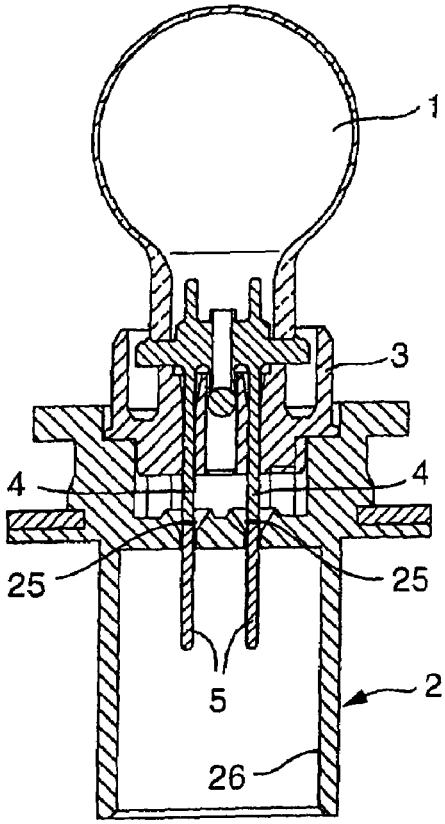

The base 3 is provided on the outside at approximately half its height with a surrounding annular projection 6, which in the installed position of the lamp 1 is overlapped by locking tongues 7 of the lamp holder 2 (FIGS. 7 and 8). The projection 6 is located at the level of a radial annular shoulder surface 8, by which the base 3 rests on a contact surface 9 of the lamp holder 2 (FIGS. 6 and 9). The flat annular shoulder surface 8 is adjoined by an end section 10, reduced in diameter, which has a flat face 11. The contact pins 4 project beyond the latter.

The lamp holder 2 has a housing 12, which in the exemplary embodiment has an oval outline. The housing 12 is open at its end turned away from the lamp 1. With this open end the housing 12 is put on a conventional connector (not represented), by which the luminous unit is connected to a current/voltage source. This connector rests on the inner wall of the housing 12 and accommodates the lengthening pins 5. Depending upon the design of the connector, the housing 12 may alternatively have some other suitable outline.

The housing 12 is closed at its end turned toward the lamp 1 by a floor 13, which has two openings 14, 15 for the lengthening pins 5. The openings 14, 15 are designed alike and have a tapered entry section 16, 17, which is converted into a cylindrical section 18, 19. The entry sections 16, 17 narrow in the direction of the cylindrical sections 18, 19. Because of the tapered entry sections 16, 17, the lengthening pins 5 are able to fit securely into the openings 14, 15 upon insertion of the incandescent lamp 1 into the lamp holder 2.

At the level of the floor 13, the lamp holder 2 is provided with a surrounding flange 20, projecting radially outward, from which stand off a plurality of locking tongues 7, distributed over the periphery. In the exemplary embodiment, four locking tongues 7 are provided, which are uniformly distributed over the periphery of the flange 20 and have a radial distance from the openings 14, 15. On the flange 20 lies a sealing ring 21, which has the same outside diameter as the flange 20 and with its radially inner edge engages in an annular groove 22, which is provided on the outer periphery of an annular projection 23. The locking tongues 7 stand off approximately vertically from the latter. Two locking tongues lying diametrically opposite one another are provided at the free end with a flange 24, projecting radially outward, which extends over the peripheral length of these locking tongues 7, which are part of a bayonet-type fastener, with which the holder 2 may be assembled in a lamp.

The lamp holder 2 advantageously is designed in one piece, so that it can be made inexpensively in one operation. The sealing ring 21 advantageously consists of another material than the lamp holder 2. The lamp holder 2 is an injection-molded part and consists for example of polyamide 6.6 with 30% glass fibers. The sealing ring 21, which consists for example of a technical elastomer, is injected onto the lamp holder 2 in the injection mold.

FIG. 8 shows the incandescent lamp 1 before insertion into the lamp holder 2. In assembly, the lengthening pins 5, as a result of the tapered entry sections 16, 17, can be inserted into the openings 14, 15 of the lamp holder 2 without any problem. The lamp 1 is inserted far enough so that the face 11 of the lamp base 3 rests on the contact surface 9 of the lamp holder 2. In the insertion operation, the locking tongues 7 are bent elastically outward by the surrounding projection 6 of the lamp base 3, until the locking projections provided at the free ends of the locking tongues 7 overlap the annular projection 6 of the lamp base 3 (FIG. 9). In this way, the lamp 1 and the holder 2 are securely connected together. In this snapped-together position the weld 25 is found between the contact pins 4 and the lengthening pins 5 in the openings 14, 15. As FIG. 9 shows, the welds 25 lie in the tapered entry sections 16, 17. The lengthening pins 5 are thereby duly guided into and fixed in the cylindrical sections 18, 19 of the openings 14, 15. When the lamp holder 2 is set on the connector, this fixing and guidance ensures that the lengthening pins 5 fit reliably into the corresponding plug-in openings of the connector.

The inner wall 26 of the housing 12 forms a sealing surface on which the connector lies sealingly.

The luminous unit of incandescent lamp 1 and holder 2 may be used in the entire field, as a direction indicator, additional direction indicator, taillight, brake light, rear fog light, back-up light, signal light, interior illumination light, and the like. The incandescent lamp 1 may be used with the on-board voltage present in each instance, with 12 volts, 19 volts or 24 volts. Since the inner wall 26 of the housing 12 is active as a sealing surface, optimal water-tightness is obtained.

The lamp holder 2 may be made of any suitable injection-moldable synthetic material. The sealing ring 21 is injected during the injection molding process.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A luminous unit, comprising:

at least one light member, said at least one light member having contacts are for connecting with an electrical connector;

at least one light member holder, connectable with the at least one light member, said at least one light member holder having and which has at least one coupling piece for releasably connecting to the electrical connector, wherein the at least one light member holder is releasably connected with the at least one light member; and a base formed as a portion of the at least one light member, the base further comprising at least one locking counterpiece for placing the base in locking connection with the at least one light member holder.

2. The luminous unit of claim 1, wherein the at least one locking counterpiece is a projection surrounding the base.

3. The luminous unit of claim 1, wherein the light member holder is an injection-molded part.

4. The luminous unit of claim 1, wherein at least one seal is injected onto to the light member holder.

5. The luminous unit of claim 1, wherein the light member holder is capable of being fastened in a structural unit by a bayonet-type fastening.

6. The luminous unit of claim 1, wherein the light member is a HiPer (High Performance) incandescent lamp.

7. The luminous unit of claim 1, wherein the light member holder has at least one locking tongue.

8. The luminous unit of claim 7, wherein the at least one locking tongue stands off from the coupling piece.

9. The luminous unit of claim 1, wherein the coupling piece is a housing of the light member holder.

10. The luminous unit of claim 9, wherein the inner side of the housing of the light member holder is a sealing surface for the electrical connector.

11. The luminous unit of claim 9, wherein the coupling piece has a floor having openings for the contacts of the light member.

12. The luminous unit of claim 11, wherein the openings each have an entry section designed tapered, which narrows in the direction of insertion of the light member.

13. The luminous unit of claim 12, wherein the entry sections are converted into guide sections.

14. The luminous unit of claim 13, wherein the guide sections have a constant cross section.

15. The luminous unit of claim 1, wherein the contacts of the light member have contact pins which are lengthened by lengthening pins.

16. The luminous unit of claim 15, wherein the lengthening pins are welded onto the contact pins.

17. The luminous unit of claim 15, further comprising a series of points between the contact pins and lengthening pins, wherein the joints between the contact pins and the lengthening pins lie in the openings of the coupling piece of the light member holder.

18. The luminous unit of claim 15, wherein the lengthening pins project into the coupling piece.

* * * * *